United States Patent [19]

Katayama

[11] Patent Number: 4,760,212

[45] **Date of Patent: * Jul. 26, 1988**

[54] ELECTRICAL INSULATING OILS

[75] Inventor: Takao Katayama, Ichihara, Japan

[73] Assignee: Idemitsu Kosan Company Limited, Tokyo, Japan

[ * ] Notice: The portion of the term of this patent subsequent to Mar. 15, 2005 has been disclaimed.

[21] Appl. No.: 54,317

[22] Filed: May 26, 1987

Related U.S. Application Data

[63] Continuation-in-part of Ser. No. 865,044, May 19, 1986, Pat. No. 4,731,495.

[30] Foreign Application Priority Data

May 29, 1985 [JP] Japan ..... 60-114255

[51] Int. Cl.[4] ..... H01B 3/22

[52] U.S. Cl. ..... 585/6.6; 208/14; 208/33; 208/212; 252/570; 585/6.3

[58] Field of Search ..... 252/570; 208/14, 33, 208/212; 585/6.3, 6.6

[56] References Cited

U.S. PATENT DOCUMENTS

| | | | |
|---|---|---|---|
| 3,121,678 | 2/1964 | Behymer et al. | 208/212 |
| 4,008,148 | 2/1977 | Masunaga et al. | 208/212 |
| 4,018,666 | 4/1977 | Reid et al. | 208/33 |
| 4,062,791 | 12/1977 | Masunaga et al. | 585/6.6 |
| 4,442,027 | 4/1984 | Sato et al. | 208/14 |

*Primary Examiner*—Robert Wax

*Attorney, Agent, or Firm*—Frishauf, Holtz, Goodman & Woodward

[57] ABSTRACT

This invention relates to an electrical insulating oil consisting essentially of a oil having a boiling point of not less than 150° C., a viscosity of 2 to 500 centistokes (at 40° C.), a pour point of not more than −35° C., a sulfur content of from more than 5 ppm to not more than 1,000 ppm, an aromatic hydrocarbon content (%$C_A$) of more than 5% and a cloud point of less than −25° C.

11 Claims, 1 Drawing Sheet

ELECTRICAL INSULATING OILS

CROSS REFERENCE TO OTHER APPLICATION

This application is a Continuation-In-Part of application Ser. No. 865,044, filed May 19, 1986, now U.S. Pat. No. 4,731,495.

BACKGROUND OF THE INVENTION

The present invention relates to an electrical insulating oil and more particularly, to an electrical insulating oil which has high thermal stability and also exhibits excellent gas absorption characteristics and streaming electrification characteristics.

In recent years, transformers with super high voltages (higher than 1 million volts) which are of large size are being developed to meet with an increased demand for electric power.

Accordingly, in order to obtain an improvement of insulating reliability, the required properties for electric insulating oils are becoming more severe. Particularly, in insulating oils for super high voltage transformers, an increment of dielectric loss tangent (tan δ) accompanied by deterioration of thermal stability is becoming a serious problem. The heat generated in a dielectric is increased with increased tan δ, which results in heating of the transformers.

This is a vital problem for an electric insulating oil composed mainly of a naphthene-based lubricant oil fraction when used as an electrical insulating oil because it is poor in stability and its dielectric loss tangent (tan δ) changes markedly.

Various causes are considered for an increase in tan δ. It is reported that the presence of copper is responsible for such an increase in tan δ although it has not yet been clarified. Thus an attempt to control an increase in tan δ by adding a small amount of 1,2,3-benzotriazole (B.T.A.) quantitatively reacting with copper to the usual mineral oil base oil has been made. But, it is difficult to keep down the increment of tan δ completely, and moreover, an introduction of an improved technique has been hoped for.

The present inventor have already succeeded in developing an electric insulating oil which can solve the above problems and is substantially decreased in a change of tan δ with time (U.S. Pat. No. 4,584,129).

For an electric insulating oil to be used at a high or ultra-high voltage, streaming electrification is necessary to be small because a danger of discharge due to streaming electrification is higher than at the usual voltage. Furthermore there is a danger that the formation of gases resulting from decomposition of the insulating oil itself is accelerated. Thus it is required for the insulating oil to be excellent in gas absorption characteristics and streaming electrification characteristics. Furthermore, it is required for the insulating oil to be excellent in dielectric breakdown voltage at a low temperature.

SUMMARY OF THE INVENTION

The present invention is intended to overcome the above problems and to provide an improved electrical insulating oil satisfying the above requirements.

An object of the present invention is to provide an electrical insulating oil which is improved in gas absorption properties and dielectric breakdown voltage at a low temperature while maintaining a change with time of tan δ at a low level and further which is of low streaming electrification.

The present invention relates to an electrical insulating oil which is consisting essentially of a mineral oil having a boiling point of not less than 150° C., a viscosity of 2 to 500 centistokes (cSt) (at 40° C.), a pour point of not more than −35° C., a sulfur content of more than 5 parts per million (ppm) to not more than 1,000 ppm, an aromatic hydrocarbon content (%$C_A$) of more than 5% and a cloud point of less than −25° C.

BRIEF DESCRIPTION OF THE DRAWINGS

The FIGURE is a graph showing a change with time of tan δ for an electrical insulating oil. In the FIGURE, the solid line indicates Comparative Example 1; the dotted line, Examples 2, 3, 5, 6 and 7; the dot and dash line, Examples 1, 4 and Comparative Example 2; the two dot and dash line, Comparative Example 3; the dot and dash line with bold stroke, Comparative Example 4; and the dotted line with bold stroke, Comparative Example 5.

DETAILED DESCRIPTION OF THE INVENTION

Figure 1:
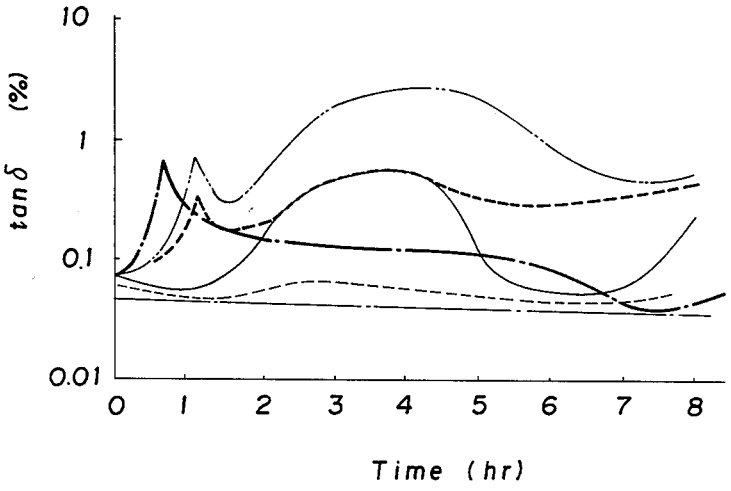

The electrical insulating oil of the present invention can be obtained by subjecting a distilled oil having a boiling point (calculated under normal pressure) of 250° to 600° C. to any one of treatments (1) to (5) as described below, and then subjected to deep-dewaxing treatment. This distillated oil can be obtained by distillating crude oils, particularly parraffinic crude oils. The distilled oil means an oil as obtained by distilling under atmospheric pressure a crude oil or by distilling under reduced pressure a residual oil resulting from distillation under atmospheric pressure of a crude oil.

Treatment (1): the distilled oil is hydrogenated, or is subjected to alkali treatment and/or sulfuric acid treating after hydrogenation.

Treatment (2): the distilled oil is subjected to solvent extracting, or is subjected to alkali treatment and/or sulfuric acid treating after solvent extracting.

Treatment (3): the distilled oil is hydrogenated and subsequently is subjected to the second stage hydrogenation treatment.

Treatment (4): the distilled oil is hydrogenated and then is subjected to the second stage hydrogenation treatment and further to the third stage hydrogenation treatment.

Treatment (5): the distilled oil is hydrogenated and then is subjected to the second hydrogenation treatment and further to alkali distillation and/or sulfuric acid treating.

These treatments can be carried out by the fundamentally same methods as employed for the electrical insulating oil as disclosed in U.S. Ser. No. 743,585. However it is necessary for hydrogenation conditions and so forth to be appropriately controlled so that an electric insulating oil having the aforementioned properties can be obtained.

One of the treatments is described below in detail.

A distilled oil is prepared from an intermediate crude oil such as Kuwait crude oil and the like by the usual method. This distilled oil is subjected to a hydrogenation treatment i.e., hydro treating process. In this treatment, undesirable components for the lubricant oil fraction are removed or changed into useful components. Furthermore the aromatic hydrocarbon content is controlled to a suitable range. In this treatment, the sulfur content is also controlled to a suitable range.

Subsequently, fractional distillation such as distillation under reduced pressure is carried out so that the necessary viscosity can be obtained. Thereafter, the known solvent dewaxing is carried out to such an extent that the pour point reaches that of the usual paraffin base oil, i.e., −15° C. to −10° C.

After this dewaxing treatment, if desired, a hydrogenation treatment is applied to increase the thermal and chemical stability of the base oil. This oil is not yet suitable as an electrical insulating oil because its pour point is still high. For this reason, subsequently, a deep dewaxing treatment is applied. For this treatment, the solvent dewaxing method under severe conditions or the catalytic hydrogenation-dewaxing method in which a zeolite catalyst is used and paraffins (mainly n-paraffins) adsorbed in pores of the catalyst are selectively decomposed in a hydrogen to remove the wax component are employed.

The hydrogenation treatment is usually carried out under such conditions that the reaction temperature is 200° to 480° C. and preferably 250° to 450° C., the hydrogen pressure is 5 to 300 kilograms per square centimeter (kg/cm$^2$) and preferably 30 to 250 kg/cm$^2$, and the amount of hydrogen introduced (per 1 kiloliter of the distilled oil supplied) is 30 to 3,000 normal cubic meter (Nm$^3$) and preferably 100 to 2,000 Nm$^3$, although the optimum conditions vary with the properties of the feed oil and so forth. The catalyst to be used for this purpose is prepared by depositing a catalyst component selected from Groups VI and VIII metals, preferably cobalt, nickel, molybdenum and tungsten on a carrier such as alumina, silica, silica.alumina, zeolite, active charcoal and bauxite by conventional methods. It is preferred for the catalyst to be preliminarily sulfurized prior to its use.

As described above, after the hydrogenation treatment, the distilled oil is subjected to various treatments. When the second stage or third stage hydrogenation treatment is applied, it suffices that the hydrogenation is carried out within the aforementioned hydrogenation condition ranges. The conditions of the first to third stage hydrogenation treatments may be the same or different. Usually the second stage hydrogenation treatment is carried out under more severe conditions than the first stage hydrogenation treatment, and the third stage hydrogenation treatment is carried out under more severe conditions than the second stage hydrogenation treatment.

The alkali treatment is carried out for the purpose of removing small amounts of the acidic substances, thereby improving the stability of the distilled ingredient. This alkali treatment is conducted by distillation under reduced pressure in the presence of an alkaline substance such as NaOH, KOH and the like.

The sulfuric acid treatment is generally carried out as a finishing step for the petroleum product; that is, this sulfuric acid treatment is applied for the purpose of improving the properties of the distilled oil by removing the aromatic hydrocarbons, particularly the polycyclic aromatic hydrocarbons, olefins, sulfur compounds and the like. In the present invention, concentrated sulfuric acid is added to the above treated oil in an amount of 0.5 to 5% by weight based on the weight of the treated oil, and the sulfuric acid treatment is carried out at a temperature of room temperature to 60° C.Thereafter the sulfuric acid is neutralized with NaOH and the like.

In the present invention, as described above, the distilled oil is treated by the treatments (1) to (5). Of these treatments, the treatments (1), (3) and (4) are suitable.

The distilled oil thus treated has such properties that the boiling point is not less than 150° C. and preferably 200° to 600° C., the viscosity is 2 to 500 cSt (at 40° C.) and preferably 3 to 40 cSt (at 40° C.), the pour point is not more than −35° C. and preferably not more than -40° C., the sulfur content is from more than 5 ppm to not more than 1,000 ppm and preferably 6 to 800 ppm, the aromatic hydrocarbon content (%$C_A$) is more than 5% and preferably 6 to 30%, and the cloud point according to ASTM D-2500 is less than −25° C. and preferably less than −30° C. When the boiling point is below 150° C., vaporization loss is large and inflammability and combustibility become so remarkable that it is not practical one.

Those having the viscosity of below 2 cSt have similar defects. On the other hand, the oil having the viscosity of over 500 cSt is disadvantageous at handling, and becomes insufficient in cooling ability. Those which are beyond the scope in pour point become large in the change of tan δ in a lapse of time, and in addition, become lowered in electric insulating ability because of the crystallization of wax portion at cold district.

Further, those which are beyond the scope in sulfur content or aromatic hydrocarbon content (%$C_A$) become low in gas absorbing capability, and in addition, become large in streaming electrification.

Those which are beyond the scope in cloud point become lowered in dielectric breakdown voltage at a low temperature and become large in the change of tan δ in a lapse of time.

The distilled oil thus obtained can be used as such as an electrical insulating oil or in combination with suitable amounts of other additives. And also the distilled oil can be added other oils so far as the characteristics of the present invention are not spoiled.

The electrical insulating oil of the present invention is not critical in its method of preparation as long as it has the aforementioned properties. In addition to the aforementioned treatments (1) to (5) and deep-dewaxing treatment, there can be employed, for example, a method in which two or more mineral oils or synthetic oils are mixed. For example, an electrical insulating oil having properties falling within the aforementioned ranges can be prepared by adding a mineral oil and/or a synthetic oil containing aromatic hydrocarbons to a mineral oil having a boiling point of not less than 150° C., a viscosity of 2 to 500 cSt (at 40° C.), a pour point of not more than −35° C., a sulfur content of not more than 5 ppm and an aromatic hydrocarbon content (%$C_A$) of not more than 5% as produced by, for example, the method disclosed in (U.S. Pat. No. 4,584,129), in a proportion of 0.5 to 50% by weight based on the weight of the above mineral oil. In this case, as the mineral oil or synthetic oil containing aromatic hydrocarbons which is to be added to the mineral oil, various oils can be used. Representative examples are an aromatic mineral oil such as a laffinate or extract resulting from solvent extraction of a lubricant fraction of a naphthene base crude oil, and its hydrogenated product, and its acid or alkali treated product or its clay treated product and a direct desulfurized gas oil; and a synthetic aromatic hydrocarbon such as alkylbenzene.

The electrical insulating oil of the present invention has such excellent properties that the change with time of tan δ is small, thermal stability is excellent, the gas absorbing capability is high, the streaming electrification is small, dielectric breakdown voltage at a low temperature is high, and the electrical insulating properties are excellent. Furthermore its anti-corrosion properties and low temperature fluidity are good.

Thus the electrical insulating oil of the present invention is effectively utilized as an insulating oil for a transformer, particularly a transfer of ultra high voltage.

The present invention is described below in greater detail with reference to the following examples.

EXAMPLES 1 TO 7, AND COMPARATIVE EXAMPLES 1 TO 5

Oils having the properties shown in Table 1 were measured for the change with time of tan δ. This measurement was conducted under such conditions that the amount of oil was 500 milliliters (ml), the temperature was 95° C., the amount of copper was 44.8 square centimeters per 100 milliliters ($cm^2$/100 ml), the amount of air was 1 liter per hour (1/hr), and the time was 8 hours (hr). The results are shown in the FIG. 1.

These oils were also measured for gas absorption, fluid electrification, anti-corrosion properties and dielectric breakdown voltage. The results are shown in Table 2.

COMPARATIVE EXAMPLE 6

The insulating oils (A) and (B) described in EXAMPLE 5 of U.S. Pat. No. 4,062,791 was each measured for a cloud point according to ASTM D-2500.

The insulating oils (A) and (B) each had a cloud point of about −20° C.

TABLE 1

| Run No. | Oil | Viscosity (at 40° C.) (cSt) | Pour Point (°C.) | Bromine Value (g/100 g) | % $C_A$*8 | Sulfur Content (ppm) | Basic Nitrogen (ppm) | Boiling Point (Initial Boiling Point) (°C.) | Cloud Point*9 (°C.) |
|---|---|---|---|---|---|---|---|---|---|
| Example | | | | | | | | | |
| 1 | Base Oil I*1 | 7.50 | −50 | 3.5 | 13 | 25 | 1≧ | 270 | 48 |
| 2 | Base Oil I 80% by weight + Direct Desulfurized Gas Oil*2 20% by weight | 7.80 | −45 | 8.3 | 20 | 240 | 3 | 190 | −41 |
| 3 | Base Oil I 80% by weight + Aromatic Mineral Oil*3 | 7.80 | −50 | 17.2 | 13 | 750 | 2 | 270 | −46 |
| 4 | Base Oil I 90% by weight + Alkylbenzene 10% by weight | 9.40 | −50 | 5.7 | 18 | 25 | 1≧ | 275 | −48 |
| 5 | Base Oil I 85% by weight + Aromatic Mineral Oil*3 10% by weight + Alkylbenzene 5% by weight | 8.20 | −50 | 12.5 | 16 | 390 | 1 | 273 | −46 |
| 6 | Base Oil II*4 75% by weight + Aromatic Mineral Oil*3 20% by weight + Alkylbenzene 5% by weight | 8.85 | −50 | 16.5 | 6.2 | 730 | 2 | 275 | −46 |
| 7 | Base Oil II*4 90% by weight + Alkylbenzene 10% by weight | 9.85 | −50 | 4.8 | 6.5 | 22 | 1≧ | 275 | −49 |
| Comparative Example | | | | | | | | | |
| 1 | Commercially Available Product*5 | 7.80 | −32.5 | 21.3 | 8.3 | 2800 | 2 | 265 | −23 |
| 2 | Base Oil II*4 | 8.36 | −50 | 2.7 | 0.8 | 1≧ | 1≧ | 275 | −48 |
| 3 | Base Oil III*6 60% by weight + Aromatic Mineral Oil*3 40% by weight | 8.5 | −37.5 | 50 | 12 | 1500 | 5 | 230 | −25 |
| 4 | Base Oil III*6 75% by weight + Aromatic Mineral Oil*3 25% by weight | 8.0 | −35 | 30 | 3.5 | 900 | 3 | 260 | −24 |
| 5 | Commercially Available Product*5 99.9% by weight + Ethylene-Propylene Copolymer*7 0.1% by weight | 7.82 | −47.5 | 21.4 | 84 | 2850 | 2 | 265 | −23 |

Note:
*1Distillate from Kuwait crude oil was subjected to hydrogenation treatment and then carried out deep dewaxing.
*2Direct desulfurized gas oil having a viscosity of 2.0 cSt (at 40° C.), a pour point of −10° C., % $C_A$ of 49 and a sulfur content of 1,100 ppm.
*3Oil having a viscosity of 9.5 cSt (at 40° C.), a sulfur content of 0.4% by weight, and a pour point of −50° C., as produced by hydrogenation of a raffinate of a lubricant fraction of a naphthene base crude oil.
*4Distillate from Kuwait crude oil was subjected to two stage hydrogenation treatment and then carried out deep-dewaxing.
*5Trade name: Transformer H
*6Distillate from Kuwait crude oil was subjected to hydrogenation treatment and then carried out dewaxing (not deep-dewaxing).
*7Ethylene-propylene copolymer having an average molecular weight of 40,000.
*8According to ASTM D-3238
*9According to ASTM D-2500

TABLE 2

| Run No. | Gas Absorption Properties*1 (mm oil) | Fluid Electrification Properties*2 Half-Life (seconds) | Anti-Corrosion Properties*3 | Dielectric*4 Breakdown Voltage (−20° C.) (KV) |
|---|---|---|---|---|
| Example | | | | |
| 1 | 20 | 1500 | Non-corrosive | 73 |
| 2 | 80 | 1000 | Non-corrosive | 77 |
| 3 | 30 | 600 | Non-corrosive | 74 |

TABLE 2-continued

| Run No. | Gas Absorption Properties*1 (mm oil) | Fluid Electrification Properties*2 Half-Life (seconds) | Anti-Corrosion Properties*3 | Dielectric*4 Breakdown Voltage (−20° C.) (KV) |
|---|---|---|---|---|
| 4 | 65 | 900 | Non-corrosive | 75 |
| 5 | 50 | 700 | Non-corrosive | 75 |
| 6 | 30 | 650 | Non-corrosive | 69 |
| 7 | 50 | 950 | Non-corrosive | 69 |
| Comparative Example | | | | |
| 1 | 85 | 1000 | Non-corrosive | 55 |
| 2 | 5 | 2000 | Non-corrosive | 69 |
| 3 | 50 | 450 | Non-corrosive | 62 |
| 4 | 25 | 800 | Non-corrosive | 58 |
| 5 | 80 | 900 | Non-corrosive | 58 |

*1Technical Report No. 6 of Insulating Oil Association (published by Electrial Insulating Material Association, Insulating Oil Group on February 1965).
*2Method described in IDEMITSU TRIBO REVIEW, No. 6, 1982, page 357
*3According to JIS C 2101.
*4A modification of JIS C 2101, which was measured at a temperature of −20° C.

What is claimed is:

1. An electrical insulating oil consisting essentially of a oil having a boiling point of not less than 150° C., a viscosity of 2 to 500 centistokes (at 40° C.), a pour point of not more than −35° C., a sulfur content of from more than 5 ppm to not more than 1,000 ppm, an aromatic hydrocarbon content (%$C_A$) of more than 5% and a cloud point of less than −25° C.

2. The oil as claimed in claim 1, wherein the oil is a mineral oil.

3. The oil as claimed in claim 1, wherein the oil is composed of 99.5 to 50% by weight of a mineral oil having a boiling point of not less than 150° C., a viscosity of 2 to 500 centistokes (at 40° C.), a pour point of not more than −35° C., a sulfur content of not more than 5 ppm, an aromatic hydrocarbon content (%$C_A$) of not more than 5% and a cloud point of less than −25° C., and 0.5 to 50% by weight of at least one oil selected from the group consisting of a mineral oil and a synthetic oil, each containing an aromatic hydrocarbon.

4. The oil as claimed in claim 1, wherein the oil is a mineral oil having a boiling point of from 200° C. to 600° C.

5. The oil as claimed in claim 1, wherein the oil is a mineral oil having a viscosity of 3 to 40 centistokes (at 40° C.).

6. The oil as claimed in claim 1, wherein the oil is a mineral oil having a pour point of not more than −40° C.

7. The oil as claimed in claim 1, wherein the oil is a mineral oil having a sulfur content of from 6 ppm to 800 ppm.

8. The oil as claimed in claim 1, wherein the oil is a mineral oil having an aromatic hydrocarbon content (%$C_A$) of from 6% to 30%.

9. The oil as claimed in claim 1, wherein the oil is a mineral oil having a cloud point of less than −30° C.

10. The oil as claimed in claim 1, wherein the oil is a mineral oil having a boiling point of from 200° C. to 600° C., a viscosity of 3 to 40 centistokes (at 40° C.), a pour point of not more than −40° C., a sulfur content of from 6 ppm to 800 ppm, an aromatic hydrocarbon content (%$C_A$) of from 6% to 30% and a cloud point of less than −30° C.

11. The oil as claimed in claim 1, wherein the oil is a mineral oil which is prepared by subjecting a distilled oil to two or three sequential hydrogenation treatments.

* * * * *